United States Patent [19]

Mitamura et al.

[11] 4,447,162

[45] May 8, 1984

[54] WATCHCASE

[75] Inventors: Gen Mitamura; Takao Eguchi; Yukio Nagami, all of Tokyo, Japan

[73] Assignee: Seiko Instruments & Electronics Ltd., Tokyo, Japan

[21] Appl. No.: 221,980

[22] Filed: Jan. 2, 1981

Related U.S. Application Data

[63] Continuation-in-part of Ser. No. 42,131, May 24, 1979.

[30] Foreign Application Priority Data

Sep. 8, 1978 [JP] Japan ..... 53-110881

[51] Int. Cl.[3] ..... G04B 37/00

[52] U.S. Cl. ..... 368/295; 368/294

[58] Field of Search ..... 368/276, 291, 292, 294, 368/295, 311, 309, 88

[56] References Cited

FOREIGN PATENT DOCUMENTS 2029609 3/1980 United Kingdom .

*Primary Examiner*—Bernard Roskoski

*Attorney, Agent, or Firm*—Robert E. Burns; Emmanuel J. Lobato; Bruce L. Adams

[57] ABSTRACT

A watchcase comprises a case body, a bezel, and a support member affixed to the bezel for removably connecting the bezel to the case body so as to permit easy removal and replacement of the bezel. The support member has at diametrically opposite locations thereof outwardly extending flange portions, and corresponding recesses are provided in the case body at diametrically opposite locations for movably receiving therein respective ones of the flange portions with sufficient clearance therebetween to enable a sufficient extent of movement of the support member relative to the case body in the diametrical direction of the flange portions to permit removal and replacement of the bezel without deformation of either the case body or bezel. A deformable elastic member is interposed between the bezel, support member and case body and the elastic member is configured so as to undergo elastic deformation during removal and replacement of the bezel thereby preventing deformation of both the case body and bezel. The elastic member has sufficient elasticity to urge the support member flange portions extend into the case body recesses upon replacement of the bezel thereby removably joining the bezel to the case body in a fluid-tight manner.

10 Claims, 13 Drawing Figures

WATCHCASE

RELATED APPLICATION

This is a continuation-in-part of application Ser. No. 42,131 filed May 24, 1979.

BACKGROUND OF THE INVENTION

The present invention relates generally to watchcases and more particularly to watchcases constructed to permit rapid removal and replacement of the bezel to the case body.

FIG. 1 shows a conventional fluidtight watchcase construction comprised of a case body 1' to the back of which is connected a back cover 4' and to the front of which is connected a glass 5' via a round bezel 6'. A watch movement 7' is mounted inside the watchcase. A sealing gasket 8' provides a fluidtight seal between the back cover and the case body. In like fashion, a fluidtight sealing gasket 28' is disposed between an upper inner step of the bezel 6' and the outer periphery of the glass 5', and another fluidtight sealing gasket 18' is disposed between the outer periphery of a lower step of the bezel 6' and an upper inner step of the case body 1' in order to fix the glass 5' and the bezel 6' to the case body 1' in a fluidtight manner. The gaskets 8', 18' and 28' are typically formed of plastic.

Although this prior art structure is exceedingly simple and possesses good fluidtight characteristics, it does suffer several drawbacks. For instance, a bezel of round shape can be easily manufactured by lathing and for this reason round bezels are in widespread use. However, in the case of a non-round bezel, it is difficult to obtain a fluidtight construction due to the difficulty in achieving accurately machined parts of non-round shape and due to the partial deformation of the bezel caused by press and mill workings which are necessary to obtain the non-round shape.

The most important consideration for manufacturing fluidtight watchcases having non-round bezels is to fix the bezel to the case body without deterioration or loss of the fluidtight function. If a rubber gasket is employed for the fluidtight sealing gasket, the fluidtight function is assured but the bezel cannot be satisfactorily fixed to the case body. On the other hand, if a plastic gasket is employed to fix the bezel, the bezel can be adequately fixed but the fluidtight function is deteriorated due to deformation of the bezel and the case body which occurs during removal and replacement of the bezel from the case body, particularly when the parts are thinly made.

SUMMARY OF THE INVENTION

It is, therefore, a primary object of the present invention to provide a watchcase construction which overcomes the aforementioned drawbacks of prior art constructions.

It is another object of the present invention to provide a watchcase in which a bezel is removably attached to a case body in a fluidtight manner.

Another object of the present invention is to provide a fluidtight watchcase having a bezel which is connected for quick and easy removal and restoral to the case body without deformation of either the case body or bezel.

DETAILED DESCRIPTION OF PREFERRED EMBODIMENTS

Figure 2A:
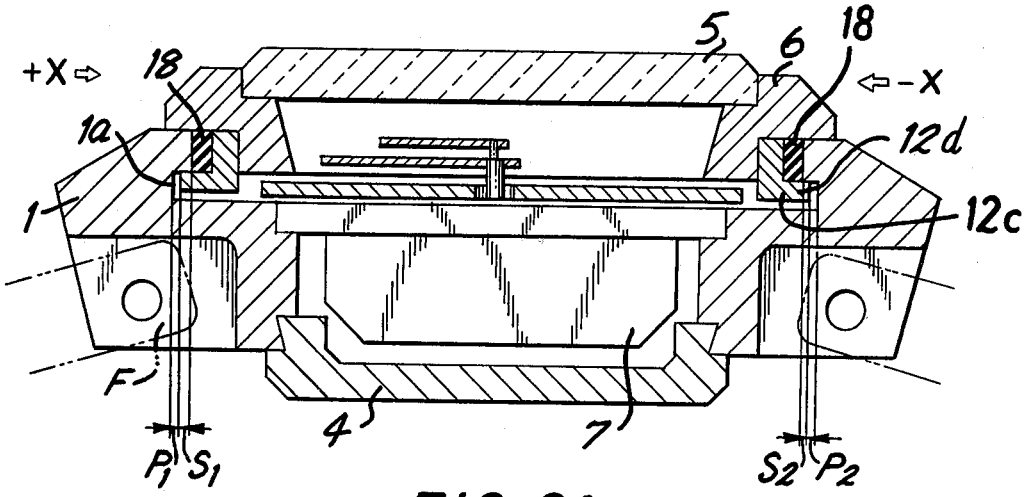
FIG. 2A is a sectional view of one embodiment of watchcase according to the present invention.
Figure 2B:
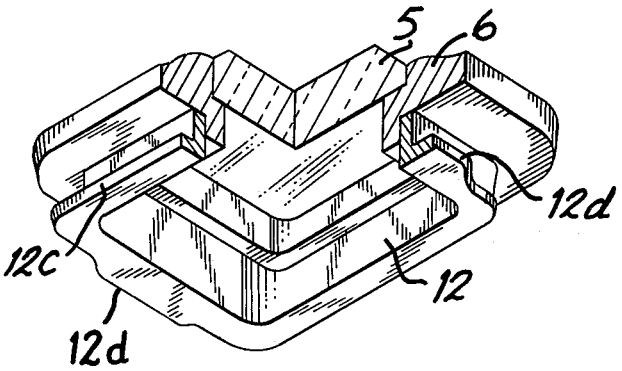
FIG. 2B is a perspective view, partly in section, of the bezel and bezel support member shown in FIG. 2A.

FIGS. 2A and 2B show one embodiment of watchcase in accordance with the principles of the present invention. A case body 1 is connected to a back cover 4 and means are provided for connecting the case body to a wrist band F. A glass 5 is sealed to an opening of a bezel 6 by a known sealing technique such as adhesion or the like. A timepiece movement 7 is mounted within the watchcase.

According to the invention, connecting means comprising a support member 12 and a deformable elastic member 18 removably connect the bezel 6 to the case body 1 so as to permit removal and restoral of the bezel to the case body. The support member 12 is provided with a peripheral flange 12*c* extending outwardly in the external diametrical direction from the upper end surface thereof and the support member 12 is provided with a set of radially extending peripheral beads 12*d*.

In the watchcase structure according to the present invention, as shown in the sectional view in the direction of the joint axis in FIG. 2A, internal recesses 1*a* are formed in the case body 1 at oppositely disposed locations and extend radially deeper than the ends of the peripheral beads 12*d* of the support member 12. S1 and S2 denote interferences where the case body and the support member are joined and overlap one another, and P1 and P2 denote variable clearances. Though S1 and S2 are ordinarily the same length, it is possible to intentionally differentiate S1 from S2 in order to prevent the joint of the case body and the support member from shifting in one direction.

The variable clearances P1 and P2 are normally defined by the balanced position of the peripheral beads and the case body recesses, or defined by the balanced position of the external shape of the flange and the internal shape of the case body in the direction of the joint axis.

Figure 3A:
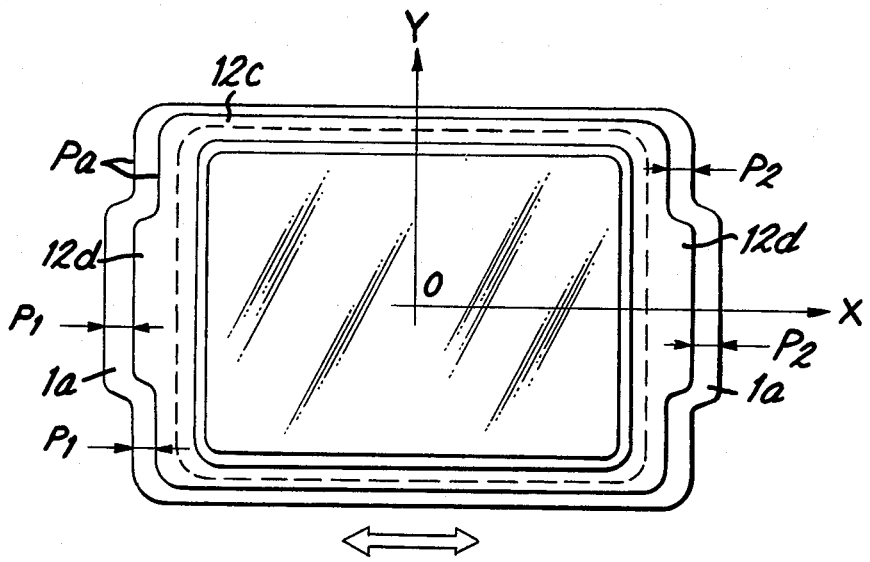
FIGS. 3A and 3B are explanatory plan views showing the manner of removal and replacement of the bezel according to the principles of the present invention.
Figure 3B:
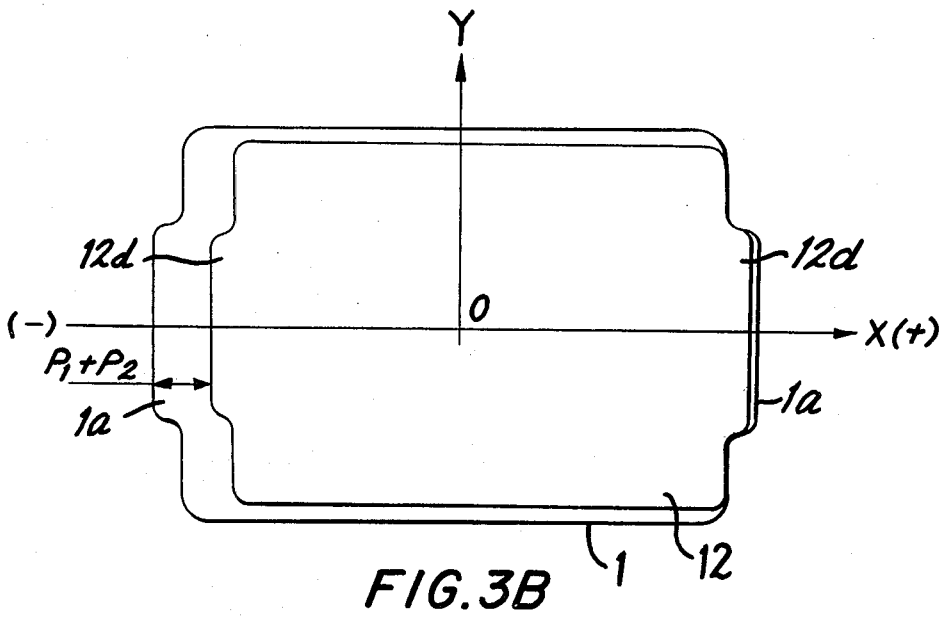

In FIG. 2A, the deformable elastic member comprises a gasket 18 interposed between the case body 1 and the bezel 6, and when the gasket 18 is removed therefrom as shown in FIGS. 3A and 3B, the support member can be moved or shifted in the diametrical axial direction of the watchcase in the direction of the joint axis X an amount corresponding to the clearances P1 or P2. It is not necessary to rely on the movement in the direction of the Y axis which meets at a right angle with the joint axis. The shifting length in the direction of the +X axis is P2 and the shifting length in the direction of the −X axis is P1. The shifting lengths can be changed according to the lengths of the interferences S1, S2 and the clearances P1, P2.

(1) In the case where P1≧S2, if the bezel (or support member) is moved in the direction of the −X axis (i.e., along the diametrical direction of the watchcase), the interference is 0 and the joint is completely removed.

(2) In the case where P1<S2, the effective interference is (S2−P1).

(3) In the case where P2≧S1, if the bezel (or support member) is moved in the direction of the +X axis (i.e., along the diametrical direction of the watchcase), the interference is 0.

(4) In the case where P2<S1, the effective interference is (S1−P2).

If either P1 or P2 is 0, the joint cannot be moved respectively in the direction of the −X axis or the +X axis. Thus in accordance with the invention, the joint can be removed without deforming the case body 1 and the support member 12 by satisfying the following relationships between the variable clearances P1, P2 and the effective interferences S1, S2: P1≧S2 or P2≧S1. However, without interposing the gasket, the bezel easily moves relative to the case body and the joint can be easily removed.

Therefore, as shown in FIG. 2A, an elastic member having elastic stability (which also serves as the gasket 18) is interposed into a clearance defined by an "Γ" shaped flange of the support member 12, the bezel 6, and the inner circumferential wall of the case body 1 so that a shift in the direction of the joint axis is restricted. Since the elasticity of the gasket 18 has a very large elastic stability in comparison with metals, the peripheral beads **12*d* of the support member 12 can be inserted and joined to the recesses 1*a* without forcedly deforming either the case body 1, the bezel 6 or the support member 12**.

Figure 4A:
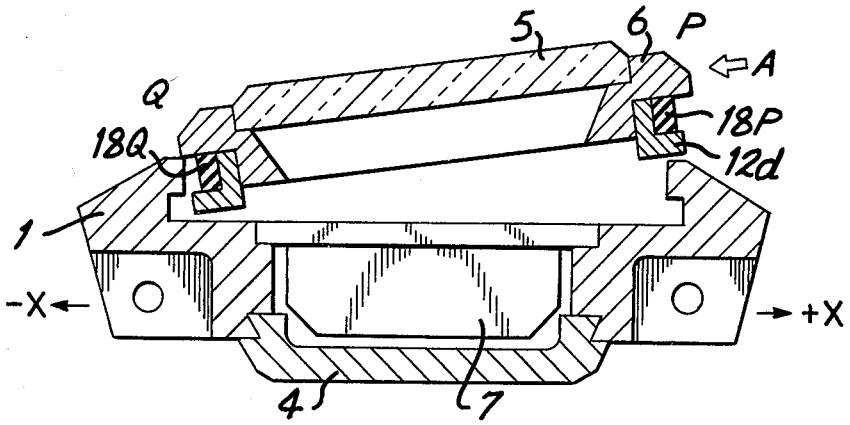
FIGS. 4A, 4B and 4C are explanatory views showing the manner of removal and replacement of the bezel of the watchcase shown in FIG. 2.
Figure 4B:
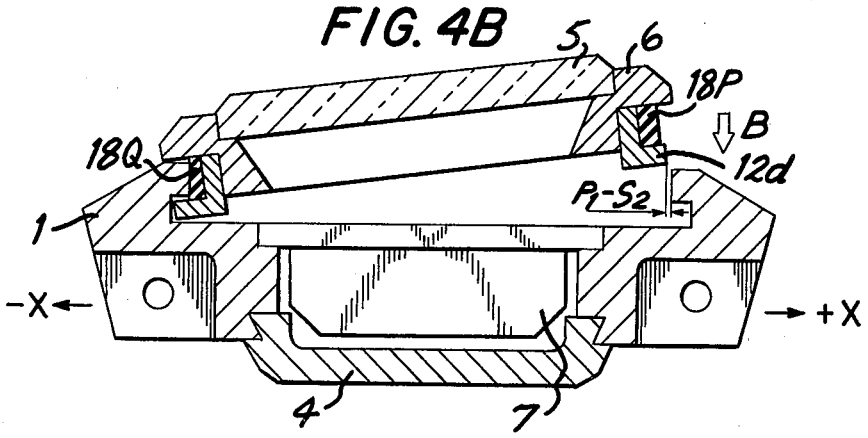
Figure 4C:
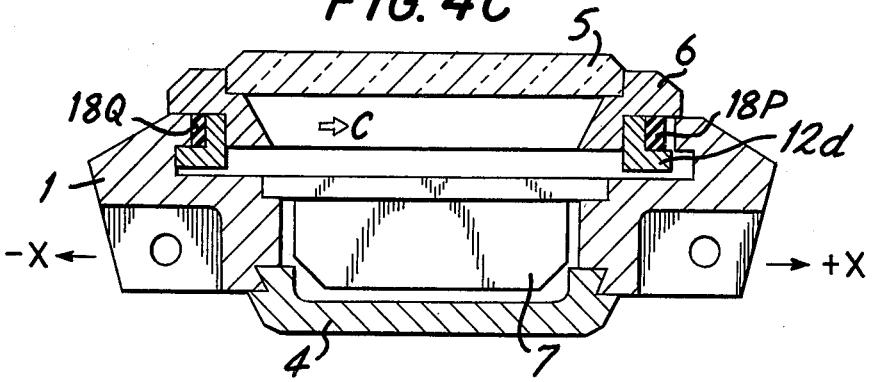

FIGS. 4A to 4C show the manner of removably joining the case body and the support member under the condition that the elastic gasket 18 is interposed therebetween. In FIG. 4A, the peripheral beads of the support member at the Q side of the bezel are inserted into corresponding recesses of the case body. In this condition, the peripheral beads cannot be completely fitted into the recesses without compressively deforming the gasket portion 18Q. Then if the bezel at the P side is pushed in the direction of the −X axis as indicated by arrow A, the gasket portion 18Q at the Q side is elastically radially compressed thereby forming a clearance (P1−S2) at the P side. When the bezel is then pushed down as indicated by arrow B, the joint condition is as shown in FIG. 4C. When the external force in the direction of the −X axis is released, the bezel is restored in the direction of the +X axis as indicated by arrow C by the elasticity of the compressed gasket portion 18Q. Finally, as shown in FIG. 2A, the joint is fixed at the balanced position wherein the stabilities of the gasket portion 18P at the P side and the gasket portion 18Q at the Q side are balanced.

Thus, by the watchcase according to the present invenion, the amount of deformation corresponding to the interferences S1 and S2 is completely absorbed by the deformation of the elastic member 18 and the case body and the bezel are not deformed at all.

Figure 1:
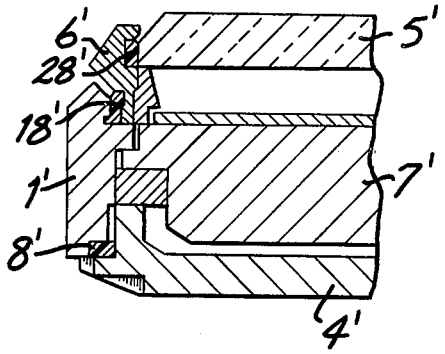
FIG. 1 PRIOR ART
FIG. 1 is a sectional view of a prior art watchcase construction having a bezel connected to a case body.

The feature of the present invention by which the bezel can be quickly and easily joined to and removed from the case body will now be described. Considering first the prior art construction shown in FIG. 1, the bezel can be removed from the case body, however, in this case, a large pushing force is needed to join the bezel to the case body since the bezel gasket is made of plastic and the gasket must be forced downwardly into the recess provided in the case body in order to prevent the bezel from releasing easily and to firmly fix the bezel in place. A special tool has to be used to push the gasket exactly in the axial direction because the gasket lacks any appreciable elasticity. Moreover, when the bezel is removed and then again joined to the case body, the fixing force is deteriorated due to creep deformation of the plastic gasket and/or the gasket is damaged due to frictional contact with the case body recess when the bezel is removed from the case body, and as a consequence, the gasket cannot be used again.

On the other hand, since the present invention employs a deformable elastic gasket preferably made of an elastic rubber, the bezel can be joined to the case body without injurious deformation, and without excessive force or special tools. Accordingly the bezel can be joined to and removed from the case body manually in a quick and easy manner, and the gasket can be used over and over again.

Figure 5:
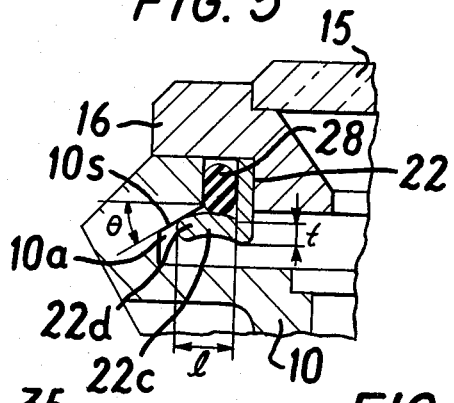
FIG. 5 is a fragmentary explanatory view of another embodiment of watchcase according to the present invention.

Other embodiments applying the principles of the present invention will now be described with reference to FIGS. 5 and 6. FIG. 5 is a fragmentary sectional view of a modified form of the case body and bezel shown in FIG. 2A. The difference between the embodiment of FIG. 5 and that of FIG. 2A is that in the FIG. 5 embodiment, a sloped surface **10*s* making an angle $\theta$ of less than 45° with respect to the joint axis (i.e., the axis along which the diametrical direction of movement of the support member 22 takes place) is provided at one wall of the recess 10*a* of the case body. The length l and the plate thickness t of the support member flange portion 22*c* are chosen so that curved flange portion 22*c* can be elastically displaced in the axial direction of the watchcase (in the direction which meets at a right angle with the contact surface of the case body and the bezel) by setting the length l of the curved flange portion 22*c*** larger than the plate thickness t.

In the FIG. 5 embodiment, no clearance exists between the contact surface of the case body 10 and the bezel 16 and such is obtained by providing the slope angle $\theta$ defined by the sloped surface **10*s* less than 45° and the flange length l larger than the plate thickness t and contacting the peripheral beads 22*d* and the sloped surface 10*s*** at a point of the sloped surface. In the present embodiment, an almost ideal joint is realized by setting the slope angle $\theta=15°$, the flange length l=0.4 to 0.5 mm and the plate thickness t=0.3 to 0.35 mm.

Figure 6A:
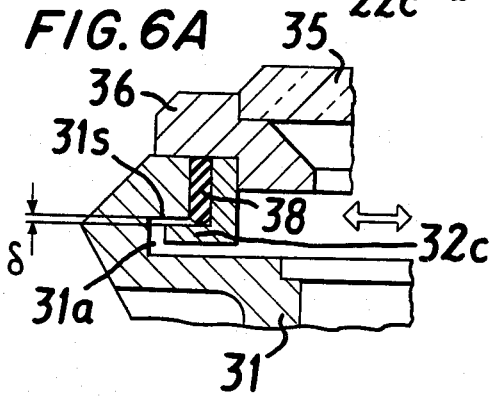
FIGS. 6A and 6B are fragmentary explanatory views of a further embodiment of watchcase according to the present invention.
Figure 6B:
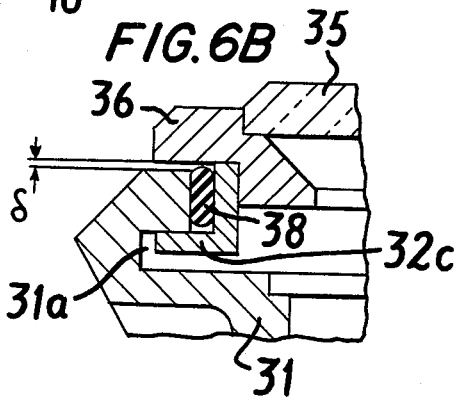

FIGS. 6A to 6B are fragmentary sectional views of another modified form of the case body and bezel shown in FIG. 2A. In this embodiment the plate thickness t and the length l of the support member flange portion **32*c* need not be precisely set, and in order to move the flange portion 32*c* in the direction of the joint axis (in the direction of the double-headed arrow in the drawing), a clearance $\delta$ ($\delta>0$) is provided between the effective surface 31*s* of the flange portion 32*c* and the recesses 31*a* as shown in FIG. 6A. After assembly of the watchcase, the clearance $\delta$ exists between the contact surface of the case body 31 and bezel 36 as shown in FIG. 6B** due to the mounting of the watch movement within the watchcase. A clearance δ of between 0.1 and 0.2 mm is acceptable though too wide a clearance impairs the fluidtight characteristic of the watch.

As a practical matter, from the standpoint of appearance of a high quality watch, the presence of a visible clearance is regarded as unpreferable.

Figure 7A:
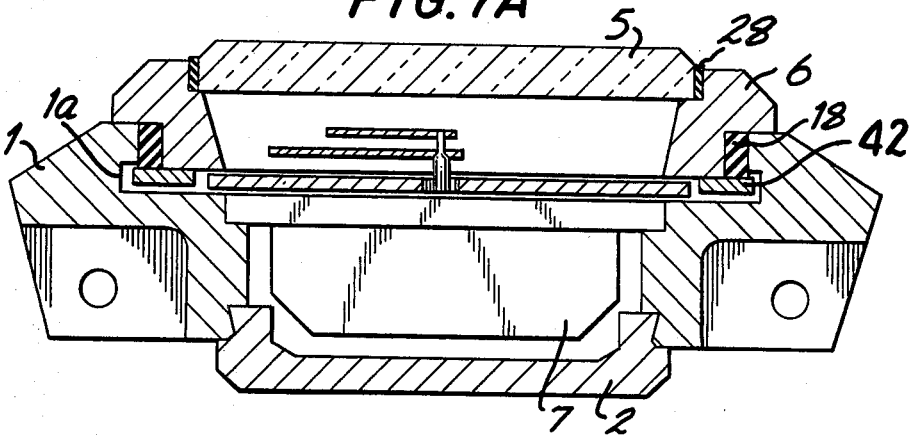
FIGS. 7A and 7B are sectional views of further embodiments according to the present invention.
Figure 7B:
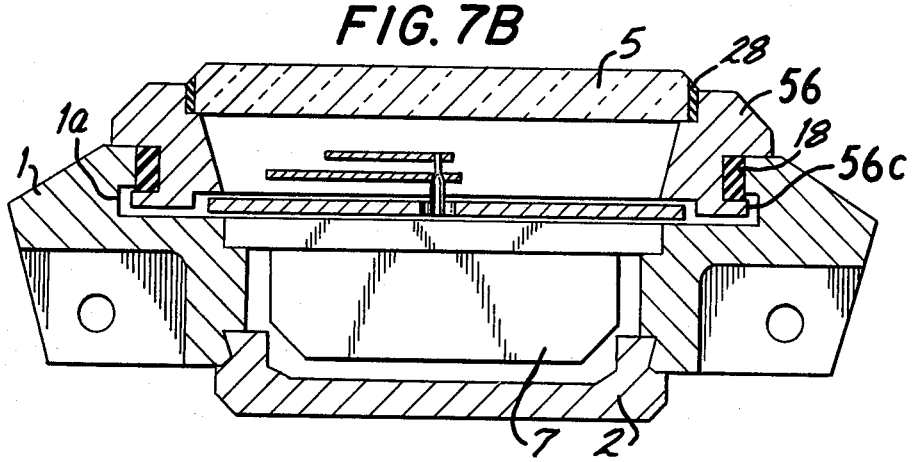

FIGS. 7A and 7B show further embodiments of watchcases applying the principles of the present invention. FIG. 7A shows an embodiment in which the flange of the support member is changed from the "Γ" shape of FIG. 2 to a support member 42 of flat platelike shape. Since the bezel 6 is provided with a step portion for holding the gasket, a similar effect as obtained by use of the "Γ" shaped flange may be obtained by use of the flat platelike support member. One distinct advantage of this embodiment is that the flat platelike support member 42 can be easily manufactured.

FIG. 7B shows an embodiment in which the support member 56c and the bezel 56 are made as an integral one-piece structure. In this embodiment, the recess for receiving the gasket 18 has a non-round shape which requires milling or a particular copying lathe. Accordingly this embodiment, while not being suitable for mass production, is suitable for production in small quantities.

We claim:

1. A watchcase comprising: a case body having oppositely disposed internal recesses therein; a bezel; a support member fixedly connected to said bezel, said support member having an outwardly extending flange extending in an outward radial direction of the watchcase from the upper end surface of the support member and having at least a pair of peripheral beads extending further outwardly from said flange and engageable with respective ones of said recesses; means defining clearances between the flange peripheral beads and the case body recesses to permit sufficient movement of the bezel relative to the case body in a diametrical direction of the watchcase to enable removal of the bezel from the case body without causing deformation of the case body, bezel or support member; biasing means for resiliently biasing the bezel to a balanced position in which the flange peripheral beads engage with respective ones of the case body recesses to thereby removably join said bezel to said case body; and wherein said recesses have a sloping surface defining an angle of less than 45° with respect to the diametrical direction of the watchcase, the length l of the peripheral beads of the support member being longer than the thickness t of the flange of the support member so that the peripheral beads can be displaced in the diametrical direction of the watchcase, and the peripheral beads of the support member contacting the sloping surface of the recesses of the case body when the support member is joined to the case body.

2. A watchcase comprising: a case body; a bezel; and connecting means removably connecting said bezel to said case body so as to permit removal of said bezel from said case body and replacement of said bezel onto said case body to define a watchcase, said connecting means comprising a support member connected to said bezel and having a flat platelike shape and having at opposite locations thereof outwardly extending flange portions, means defining recesses in said case body at opposite locations and movably receiving therein respective ones of said flange portions with sufficient clearance therebetween to enable a sufficient extent of movement of said support member relative to said case body in a diametrical direction of the watchcase to permit removal and replacement of said bezel without deformation of said case body, bezel or support member, and a deformable elastic member interposed between said support member and case body and configured so as to undergo elastic deformation during removal and replacement of said bezel thereby preventing deformation of said case body, bezel and support member and having sufficient elasticity to urge said support member to a balanced position in which the support member flange portions extend into the case body recesses upon replacement of said bezel thereby removably connecting said bezel to said case body.

3. A watchcase according to claim 2; wherein said bezel and platelike-shaped support member comprise an integral one-piece structure.

4. A watchcase comprising: a case body; a bezel; and connecting means removably connecting said bezel to said case body so as to permit removal of said bezel from said case body and replacement of said bezel onto said case body to define a watchcase, said connecting means comprising a support member connected to said bezel and having at opposite locations thereof outwardly extending flange portions, means defining recesses in said case body at opposite locations and movably receiving therein respective ones of said flange portions with sufficient clearance therebetween to enable a sufficient extent of movement of said support member relative to said case body in a diametrical direction of the watchcase to permit removal and replacement of said bezel without deformation of said case body, bezel or support member, and a deformable elastic member interposed between said support member and case body and configured so as to undergo elastic deformation during removal and replacement of said bezel thereby preventing deformation of said case body, bezel and support member and having sufficient elasticity to urge said support member to a balanced position in which the support member flange portions extend into the case body recesses upon replacement of said bezel thereby removably connecting said bezel to said case body; and wherein said support member flange portions have a curved shape, and said case body recesses have a sloped surface which engage with respective ones of the curved flange portions.

5. A watchcase according to claim 4; wherein the sloped surface of the case body recesses defines an angle less than 45° with respect to the diametrical direction of movement of said support member, and the length of the curved flange portions is greater than the thickness of the curved flange portions.

6. A watchcase according to claim 5; wherein said angle is on the order of 15°, and said curved flange portions have a length of about 0.4 to 0.5 mm and a thickness of about 0.3 to 0.35 mm.

7. A watchcase according to any one of claims 2, 3, 4, 5 or 6, wherein said deformable elastic member has sufficient elasticity and shape to effect a fluidtight seal between said bezel and case body.

8. A watchcase according to any one of claims 2, 3, 4, 5 or 6; wherein said bezel has a non-round shape.

9. A watchcase according to claim 1; wherein said biasing means comprises an elastic member interposed in the clearances and having sufficient elasticity to restrict the movement of the bezel relative to the case body and to prevent the penetration of water into the case body.

10. A watchcase according to either claim 1 or 9; wherein said bezel has a non-round shape.

* * * * *